US012648624B1

(12) United States Patent
Zhuang

(10) Patent No.: US 12,648,624 B1
(45) Date of Patent: Jun. 9, 2026

(54) DECORATIVE ACCESSORY FIXING STRUCTURE FOR SHOES WITH HOLES

(71) Applicant: Mingzhi Zhuang, Jinjiang (CN)

(72) Inventor: Mingzhi Zhuang, Jinjiang (CN)

( * ) Notice: Subject to any disclaimer, the term of this patent is extended or adjusted under 35 U.S.C. 154(b) by 0 days.

(21) Appl. No.: 18/975,451

(22) Filed: Dec. 10, 2024

(51) Int. Cl.
*A43C 19/00* (2006.01)

(52) U.S. Cl.
CPC ..... *A43C 19/00* (2013.01)

(58) Field of Classification Search
CPC ..... A43B 3/0078; A43B 23/24; A43C 3/00; A43C 5/00; A43C 11/22; A43C 11/24; A43C 19/00
USPC ..... 36/136; 40/636; 2/245
See application file for complete search history.

(56) References Cited

U.S. PATENT DOCUMENTS 25,928 A * 10/1859 Wilcox ..... A44B 5/002 24/97
1,205,047 A * 11/1916 Snyder ..... A44B 1/44 24/94
2009/0183344 A1* 7/2009 Polsky ..... A43B 3/0078 24/1
2013/0064709 A1* 3/2013 Allen ..... A61B 50/20 422/243
2013/0067641 A1* 3/2013 Allen ..... A43B 23/24 2/245
2014/0259295 A1* 9/2014 Guglielmo ..... A43B 1/0027 2/245

* cited by examiner

*Primary Examiner* — Ted Kavanaugh

(57) ABSTRACT

A decorative accessory fixing structure for shoes with holes, including an upper crossbeam, two vertical connecting members, and two lower crossbeams; the upper crossbeam is located on an outside of shoe holes as a support fixing member for the decorative accessories, or on an inside of the shoe holes as a support limiting member; two vertical connecting members penetrate through holes in the shoe and connecting the upper crossbeam and lower crossbeams; two lower crossbeams, respectively fixedly attached to lower ends of two vertical connecting members, are disposed on an inside of shoe holes as a support limiting member or disposed on an outside of shoe holes as a support fixing member for the decorative accessory. And the invention can be applied to a variety of hole shapes, including circular, rectangular, triangular, polygonal and irregularly shaped holes as well as specific holes such as shoelace holes.

8 Claims, 2 Drawing Sheets

DECORATIVE ACCESSORY FIXING STRUCTURE FOR SHOES WITH HOLES

1. TECHNICAL FIELD

The invention belongs to the technical field of installation of a decorative accessory for shoes, specifically relates to a decorative accessory fixing structure for shoes with holes.

2. BACKGROUND ART

In a variety of shoes with holes, the installation of decorative accessories has become an important means to enhance their aesthetic appearance. Most of the decorative accessory structures widely used in the current market rely on an I-shaped structure with an arbitrary longitudinal cross-section, which combines a penetrating shaft in a center and shoulders for fixation at both ends, so as to fix the decorative accessory firmly to the shoes with holes. However, such conventional designs face a plurality of challenges in practical application, in particular, the strict limitations of the size of the shoe aperture and the thickness of the material directly affect flexibility and compatibility of the installation of the decorative accessory, and stability and durability of the decorative accessory are also affected to a certain extent.

In view of this, the market is in urgent need of an innovative connection structure, which is designed to adapt to a wider range of shoe design specifications and material characteristics, and at the same time significantly improve the stability and service life of the decorative accessories.

3. SUMMARY OF THE INVENTION

The technical problem to be solved by the invention is to provide a decorative accessory fixing structure for shoes with holes in response to the deficiencies existing in the prior art. The invention can be used for holes of various shapes, including holes of circles, rectangles, triangles, polygons, holes of specific irregular shapes as well as specific holes such as holes for shoelaces, and is highly versatile and can be widely used in holey shoes and other shoes with holes, and can save material and reduce production cost while ensuring that decorative accessories are firmly installed.

This solution is realized by the following technical measures: a decorative accessory fixing structure for shoes with holes, including

- an upper crossbeam, which is located on an outside of shoe holes as a support fixing member for the decorative accessories, or on an inside of the shoe holes as a support limiting member;
- two vertical connecting members, penetrating through holes in the shoe and connecting the upper crossbeam and lower crossbeams, and a gap is left between one end of two vertical connecting members connected to the lower crossbeams;
- two lower crossbeams, respectively fixedly attached to lower ends of two vertical connecting members, are disposed on an inside of shoe holes as a support limiting member or disposed on an outside of shoe holes as a support fixing member for the decorative accessory.

Preferably, two vertical connecting members are set inclined from top to bottom and from inside to outside.

Preferably, when the upper crossbeam is located on the outside of the shoe holes as the support fixing member of the decorative accessory, two lower crossbeams are located on the inside of the shoe holes as the support limiting member, in which case the upper crossbeam comprises a disk-shaped base portion and an upper surface of the disk-shaped base portion is a flat surface;

- when the upper crossbeam is located on the inside of the shoe holes as a support limiting member, two lower crossbeams are located on the outside of the shoe holes as a support fixing member for the decorative accessory, at which time the upper crossbeam comprises a ball-cap portion and a disk-shaped base portion, and a side of the lower crossbeam far away from the vertical connecting member is a flat surface.

Preferably, said vertical connecting members and lower crossbeams are elastic members.

Preferably, two lower crossbeams are symmetrically provided on opposite sides of lower ends of two vertical connecting members.

Preferably, two vertical connecting members are symmetrically fixed to a lower surface of the upper crossbeam.

Preferably, the spacing between the upper crossbeam and lower crossbeams is greater than the height of shoe holes;

- when two vertical connecting members are in their natural state, the distance between back-to-back ends of two lower crossbeams is greater than size of holes at corresponding position;
- when two vertical connecting members are in a compressed state in which lower ends are in contact with each other, a sum of thicknesses of two vertical connecting members and two lower crossbeams is equal to or less than the size of the hole at the corresponding position.

Preferably, center lines of two vertical connecting members and two lower crossbeams are coplanar.

Preferably, said upper crossbeam, vertical connecting members and lower crossbeams are an integrally molded structure.

Preferably, two lower crossbeams are elastic members of same material as the vertical connecting members as well as of same cross-sectional shape and size, and the cross-sectional shapes of the lower crossbeams and vertical connecting members are square.

Compared with the prior art, the invention has the following advantages:

1. the upper crossbeam, two vertical connecting members and two lower crossbeams form a π-shape structure, which can ensure that the whole decorative accessory fixing structure has a high degree of adaptability and solidity in the process of installation and use, and can save materials and reduce the cost of production while ensuring that the decorative accessory is firmly installed;
2. both the upper crossbeam and lower crossbeams in the invention can be used as the support fixing member of the decorative accessory, which is more versatile and can be adapted to the installation needs of more kinds of decorative accessories: when the upper crossbeam is used as the support fixing member of the decorative accessory, it is suitable for holes in the shape of rectangle or shaped shape, at this time, the upper crossbeam is located at the outside of the shoe holes, which provides a flat base and facilitates fixing of decorative accessory in all kinds of shapes; when installing, the lower crossbeams are driven through the holes by compressing vertical connecting members, which makes the installation process simple and adapts to a variety of holes designs; when the lower crossbeams are used as a support fixing member for the decorative accessories, it is suitable for use in round holes and in scenes where comfort needs to be enhanced (the upper crossbeam with a ball-cap portion), where the upper crossbeam, two vertical connecting members, decorative accessories, and two lower crossbeams form a closed trapezoidal or triangular structure; the structure is able to penetrate the holes more tightly, and the use of the autonomous expansion and contraction properties of two vertical connecting members as elastic trapezoidal or triangular hypotenuse ensures a stronger and more stable and secure connection. Compared with the traditional I-shaped beam structure, this design can not only improve the compactness of the fixing, two vertical connecting members can form a double insurance, compared to the structural form of a more redundant, when a vertical connecting member breaks, the other vertical connecting member also ensures that the decorative accessory fixing structure can continue to be used for a period of time, with a certain degree of fault-tolerance mechanism, but also effectively enhance the comfort of wearing;

3. the invention can simplify the installation process: the overall elastic design makes the installation process simpler, without complex adjustment, just a simple squeeze and passing through holes can complete the installation, and automatically recover to form a stable structure;
4. the invention can be applied in multiple scenarios: it is not only applicable to hole shoes, but also can be applied to other shoes with holes, providing great application flexibility and market potential, not only broadening the application scope of decorative accessories, but also bringing consumers richer and more varied and superior quality decorative choices.

It can be seen that the invention has outstanding substantive features and significant progress compared with the prior art, and the beneficial effects of its implementation are also obvious.

4. BRIEF DESCRIPTION OF ACCOMPANY DRAWINGS

Figure 1:
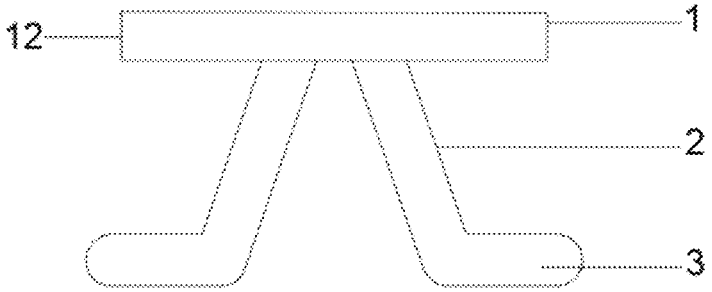
FIG. 1 is a front view of the invention when the upper crossbeam is used as a support fixing member of the decorative accessory.
Figure 2:
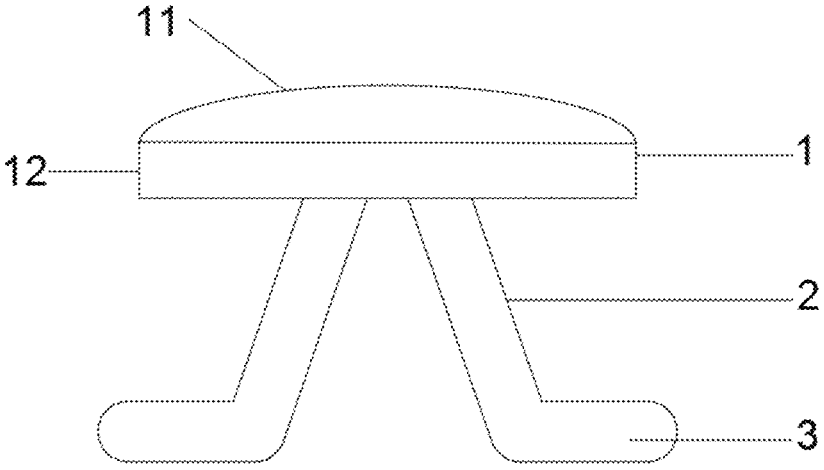
FIG. 2 is a front view of the invention when two lower crossbeams are used as a support fixing member of the decorative accessory.
Figure 3:
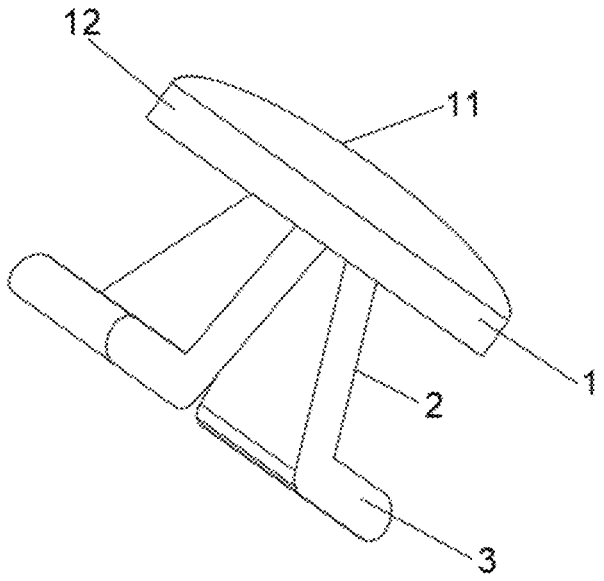
FIG. 3 is a first three-dimensional structural diagram of the invention when two lower crossbeams are used as a support fixing member of the decorative accessory.
Figure 4:
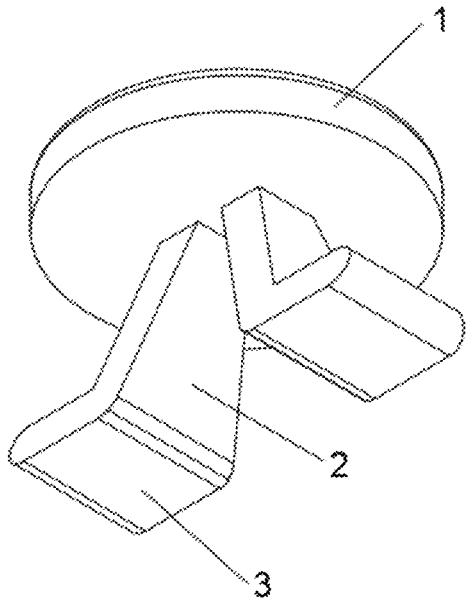
FIG. 4 is a second three-dimensional structural diagram of the invention when two lower crossbeams are used as a support fixing member of the decorative accessory.

As shown in accompanying drawings: 1 upper crossbeam, 11 ball-cap portion, 12 disk-shaped base portion, 2 vertical connecting member, 3 lower crossbeam.

5. SPECIFIC EMBODIMENT OF THE INVENTION

In order to be able to clearly illustrate the technical features of the present solution, the following is a description of the program by means of specific embodiments and in conjunction with the accompanying drawings thereof.

A decorative accessory fixing structure for shoes with holes, including an upper crossbeam 1, which is located on an outside of shoe holes as a support fixing member for the decorative accessories, or on an inside of the shoe holes as a support limiting member;

two vertical connecting members 2, penetrating through holes in the shoe and connecting the upper crossbeam 1 and lower crossbeams 3, and a gap is left between one end in of two vertical connecting members 2 connected to the lower crossbeams 3;

two lower crossbeams 3, respectively fixedly attached to lower ends of two vertical connecting members 2, are disposed on an inside of shoe holes as a support limiting member or disposed on an outside of shoe holes as a support fixing member for the decorative accessory.

When the upper crossbeam 1 is located on the outside of the shoe holes as the support fixing member of the decorative accessory, two lower crossbeams 2 are located on the inside of the shoe holes as the support limiting member, in which case the upper crossbeam 1 comprises a disk-shaped base portion 12 and an upper surface of the disk-shaped base portion 12 is a flat surface; the decorative accessory is fixed on an upper surface of the disk-shaped base portion 12, and a lower surface of the disk-shaped base portion 12 is in close contact with an outer surface of the shoe. The lower crossbeam 3 is disposed within the holes of the shoe and affixed to an inner surface of the shoe to limit and fix the entire fixing structure, and two lower crossbeams 3 are able to be extruded and deformed to adapt to various shapes of the holes during installation and easily pass through the shoe holes, and two lower crossbeams 3 recover their shapes after passing through the shoe holes and firmly affixed to the inner surface of the shoe to provide a stabilizing support and improve the adaptability and firmness of the overall structure.

When the upper crossbeam 1 is located on the inside of the shoe holes as a support limiting member, two lower crossbeams 3 are located on the outside of the shoe holes as a support fixing member for the decorative accessory, at which time the upper crossbeam 1 comprises a ball-cap portion 11 and a disk-shaped base portion 12, a diameter of a flat end of the ball-cap portion 11 is equal to a diameter of the disk-shaped base portion 12, and it is preferred that the ball-cap portion 11 and the disk-shaped base portion 12 are integrally molded, and this structural form of the upper crossbeam 1 not only ensures that the entire fixing structure is fixed and limited in the shoe, but also facilitates the upper crossbeam 1 to pass through the shoe holes for installation; a side of the lower crossbeam 3 far away from the vertical connecting member 2 is a flat surface, and flat surfaces of two lower crossbeams 3 jointly support and fix the decorative accessory, and the upper crossbeam 1 is located inside the shoe holes and fits the inner surface of the shoe to limit and fix the entire fixing structure.

Said upper crossbeam 1, vertical connecting members 2 and lower crossbeams 3 are an integrally molded structure to ensure strength of the fixing structure.

Two vertical connecting members 2 are symmetrically fixed to a lower surface of the upper crossbeam 1; said vertical connecting members 2 and lower crossbeams 3 are elastic members, and the upper crossbeam 1 is also an elastic member; preferably, the upper crossbeam 1, vertical connecting members 2 and lower crossbeams 3 are made of plastic materials, two vertical connecting members 2 can be compressed and deformed during the installation process and recover their shape after the installation is completed, so as to adapt to the installation requirements of different sizes and shapes of holes. Two vertical connecting members 2 are set inclined from top to bottom and from inside to outside (based on the orientation of the view shown in FIG. 1), and two lower crossbeams 3 are symmetrically provided on opposite sides of lower ends of two vertical connecting members 2; center lines of two vertical connecting members 2 and two lower crossbeams 3 are coplanar, so that stability and force equalization of the support can be guaranteed.

Two lower crossbeams 3 are elastic members of same material as the vertical connecting members 2 as well as of same cross-sectional shape and size, and the cross-sectional shapes of the lower crossbeams 3 and vertical connecting members 2 are square. Preferably, the lower crossbeam 3 and the vertical connecting members 2 are square plate structures, and connecting ends of both of them have a round arc transition, which can also ensure a firm connection while ensuring that the whole fixing structure can be installed to the shoe smoothly.

The spacing between the upper crossbeam 1 and lower crossbeams 3 is greater than the height of shoe holes to ensure that the upper crossbeam 1 and lower crossbeams 3 can be installed to two sides of the shoe holes.

When two vertical connecting members 2 are in their natural state, the distance between back-to-back ends of two lower crossbeams 3 is greater than size of holes at corresponding position, to ensure that the lower crossbeams 3 will not come out of the hole, thus ensuring that the decorative accessory is securely fastened.

When two vertical connecting members 2 are in a compressed state in which lower ends are in contact with each other, a sum of thicknesses of two vertical connecting members 2 and two lower crossbeams 3 is equal to or less than the size of the hole at the corresponding position to ensure that two lower crossbeams 3 can smoothly pass through the holes when installed into the holes of the shoe, two lower crossbeams 3 pass through the holes and are released to reset and unfold to restore their shape under their own elasticity to provide support and fixation inside the shoe, so as to realize a stable fixation effect for the decorative accessory.

When the upper crossbeam 1 is located on the outside of the shoe holes as the support fixing member of the decorative accessory, two vertical connecting members 2 are compressed, and two vertical connecting members 2 drive two lower crossbeams 3 to synchronously move in the same direction until lower ends of two vertical connecting members 2 come into contact with each other, and then the entire fixing structure of the decorative accessory is moved towards the hole of the shoe, and when the lower ends of the two lower crossbeams 3 come into contact with edges of the holes, as the entire decorative accessory fixing structure continues to move, the edges of the holes extrude two lower crossbeams 3, causing free ends of two lower crossbeams 3 to rotate upward, and when two lower crossbeams 3 have completely passed through the holes, two lower crossbeams 3 will recover their shapes without being extruded by the holes and will fit onto the inner surface of the shoe, and the installation of the decorative accessory will then be completed.

When two lower crossbeams 3 are located on the outside of the shoe holes as the support fixing member of the decorative accessory, the decorative accessory is bonded and fixed with surfaces of two lower crossbeams 3, and the ball-cap portion 11 of the upper crossbeam 1 is placed in the holes of the shoe and extruded to the holes until the disk-shaped base portion 12 enters into the inside of the shoes through the holes and adheres to the inner surface of the shoe, and at the same time, two vertical connecting members 2 can also adapt to different sizes and shapes of the holes, and the installation of the decorative accessory is completed.

In order to ensure firm installation while taking production costs into account, the size of each component of the present invention is preferably configured as follows: the diameter of the flat end of the disk-shaped base portion 12 and the ball-cap portion 11 is 0.4-2 cm, the spacing between one end of two vertical connecting members 2 connected to the upper crossbeam 11 is 0.1-1 cm, the spacing between one end of two vertical connecting members 2 connected to the lower crossbeams 3 is 0.3-1.2 cm, the maximum distance between the disk-shaped base portion 12 and the lower crossbeams 3 (i.e., the spacing between the disk-shaped base portion 12 and opposite sides of the lower crossbeams 3) is 0.6-2 cm, and the minimum distance between the disk-shaped base portion 12 and the lower crossbeams 3 (i.e., the spacing between the disk-shaped base portion 12 and opposite sides of the lower crossbeams 3) is 0.1-1 cm.

In the invention, the upper crossbeam 1, two vertical connecting members 2 and two lower crossbeams 3 form a π-shape structure, which can save materials and reduce the cost of production while ensuring that the decorative accessory is firmly installed; no additional tools are required for installation, the invention can be quickly installed by squeezing and restored to a solid fixed state. And the π-shaped structure formed by the upper crossbeam 1 with two vertical connecting members 2 and two lower crossbeams 3 can be applied to a variety of hole shapes, including circular, rectangular, triangular, polygonal and irregularly shaped holes as well as specific holes such as shoelace holes, which is versatile and significantly improves the applicability and market application potential of the entire decorative accessory fixing structure.

Both the upper crossbeam 1 and lower crossbeams 3 in the invention can be used as the support fixing member of the decorative accessory, which is more versatile and can be adapted to the installation needs of more kinds of decorative accessories.

The upper crossbeam 1, two vertical connecting members 2 and two lower crossbeams 3 in the present invention are made of elastic material, which can enhance deformation ability of the three during installation and recovery after the installation is completed. Two vertical connecting members 2 and two lower crossbeams 3 have elastic properties, and can deform during installation and adapt themselves to the installation of different aperture diameters and material thicknesses, and can adapt to multiple installations and disassemblies, and can maintain the stability of the structure. And there is a gap between one end of two vertical connecting members 2 connected to the lower crossbeams 3, so that it can be deformed flexibly during installation and remain stable after recovery.

The invention and its embodiments have been described above, but the description is not limited thereto; only one embodiment of the invention is shown in the drawings, and the actual structure is not limited thereto. In general, it is to be understood by those skilled in the art that non-creative design of structural forms and embodiments that are similar to the technical solutions without departing from the spirit of the invention shall all fall within the protective scope of the invention.

The invention claimed is:

1. A decorative accessory fixing structure is configured to shoes with holes, including an upper crossbeam is configured to be located on an outside of shoe holes as a support fixing member for the decorative accessories, or configured to on an inside of the shoe holes as a support limiting member;

two vertical connecting members are configured to penetrate through holes in the shoe and configured to connect the upper crossbeam and two lower crossbeams, and a gap is left between one end of two vertical connecting members connected to the two lower crossbeams;

the two lower crossbeams, respectively fixedly attached to lower ends of two vertical connecting members, are configured to be disposed on an inside of shoe holes as a support limiting member or configured to be disposed on an outside of shoe holes as a support fixing member for the decorative accessory;

two vertical connecting members are set inclined from top to bottom and from inside to outside;

when the upper crossbeam is configured to located on the outside of the shoe holes as the support fixing member of the decorative accessory, the two lower crossbeams are configured to located on the inside of the shoe holes as the support limiting member, in which case the upper crossbeam comprises a disk-shaped base portion and an upper surface of the disk-shaped base portion is a flat surface;

when the upper crossbeam is configured to located on the inside of the shoe holes as a support limiting member, the two lower crossbeams are configured to located on the outside of the shoe holes as a support fixing member for the decorative accessory, at which time the upper crossbeam comprises a ball-cap portion and a disk-shaped base portion, and a side of the lower crossbeam far away from the vertical connecting member is a flat surface;

the upper crossbeam (1), two vertical connecting members (2) and two lower crossbeams (3) in the present invention are made of elastic material, both the upper crossbeam (1) and lower crossbeams (3) can be used as the support fixing member of the decorative accessory;

diameter of a flat end of the ball-cap portion (11) is equal to a diameter of the disk-shaped base portion (12);

the diameter of the flat end of the disk-shaped base portion (12) and the ball-cap portion (11) is 0.4-2 cm, the spacing between one end of two vertical connecting members (2) connected to the upper crossbeam (11) is 0.1-1 cm, the spacing between one end of two vertical connecting members (2) connected to the lower crossbeams 3 is 0.3-1.2 cm, the maximum distance between the disk-shaped base portion (12) and the lower crossbeams (3) is 0.6-2 cm, and the minimum distance between the disk-shaped base portion (12) and the lower crossbeams (3) is 0.1-1 cm.

2. The decorative accessory fixing structure is configured to shoes with holes of claim 1, wherein said vertical connecting members and the two lower crossbeams are elastic members.

3. The decorative accessory fixing structure is configured to shoes with holes of claim 2, wherein the two lower crossbeams are symmetrically provided on opposite sides of lower ends of two vertical connecting members.

4. The decorative accessory fixing structure is configured to shoes with holes of claim 3, wherein two vertical connecting members are symmetrically fixed to a lower surface of the upper crossbeam.

5. The decorative accessory fixing structure is configured to shoes with holes of claim 4, wherein the spacing between the upper crossbeam and the two lower crossbeams are configured to greater than the height of shoe holes;

when two vertical connecting members are in their natural state, the distance between back-to-back ends of the two lower crossbeams is configured to greater than size of holes at corresponding position;

when two vertical connecting members are in a compressed state in which lower ends are in contact with each other, a sum of thicknesses of two vertical connecting members and the two lower crossbeams is equal to or less than the size of the hole at the corresponding position.

6. The decorative accessory fixing structure is configured to shoes with holes of claim 5, wherein center lines of two vertical connecting members and the two lower crossbeams are coplanar.

7. The decorative accessory fixing structure is configured to shoes with holes of claim 6, wherein said upper crossbeam, vertical connecting members and the two lower crossbeams are an integrally molded structure.

8. The decorative accessory fixing structure is configured to shoes with holes of claim 7, wherein the two lower crossbeams are elastic members of same material as the vertical connecting members as well as of same cross-sectional shape and size, and the cross-sectional shapes of the two lower crossbeams and vertical connecting members are square.

* * * * *